United States Patent [19]

Netters

[11] 4,248,477

[45] Feb. 3, 1981

[54] FURNITURE CONSTRUCTION

[76] Inventor: Elbert Netters, P.O. Box 25534, Phoenix, Ariz. 85002

[21] Appl. No.: 936,760

[22] Filed: Aug. 25, 1978

[51] Int. Cl.[3] ..... A47B 39/00

[52] U.S. Cl. ..... 297/135; 108/1; 108/94; 297/137

[58] Field of Search ..... 297/135, 119, 121, 157, 297/136, 137, 138; 108/1, 4, 92, 93, 94, 95, 96, 103, 104, 105

[56] References Cited

U.S. PATENT DOCUMENTS

| | | | |
|---|---|---|---|
| 783,335 | 2/1905 | Truxal | 108/1 X |
| 2,277,929 | 3/1942 | Meyer | 297/137 |
| 2,454,599 | 11/1948 | Dunson | 297/137 |
| 2,711,898 | 6/1955 | Iasillo | 108/94 X |
| 3,601,443 | 8/1971 | Jones | 108/103 X |
| 4,060,038 | 11/1977 | Ruvolo | 108/104 X |

FOREIGN PATENT DOCUMENTS

| | | | |
|---|---|---|---|
| 1112861 | 3/1956 | France | 297/157 |
| 84422 | 12/1964 | France | 108/94 |
| 103946 | 7/1916 | United Kingdom | 297/137 |

*Primary Examiner*—Roy D. Frazier
*Assistant Examiner*—Peter A. Aschenbrenner
*Attorney, Agent, or Firm*—Drummond and Nelson

[57] ABSTRACT

A furniture construction comprised of a unitary base, supports, attached at their lower ends to the base, rising upwardly and outwardly from the base, and individual work surfaces attached to the upper ends of the supports. A peripheral area of free space is defined outside and beneath the supports and individual work surfaces which allows chairs to be positioned beneath the work surfaces without contacting the inclined supports.

1 Claim, 7 Drawing Figures

FURNITURE CONSTRUCTION

This invention relates to a multi-purpose structure which may be used either as furniture or as a display stand.

In another respect, the invention relates to a structure having a base with several columns radiating upwardly and outwardly therefrom with a work surface surmounting the top of each of said columns.

In still another respect, the invention relates to a multi-purpose structure such as described in which the various work surfaces are placed at convenient distances above said base.

In yet another respect, the invention relates to a multi-purpose structure as described above in which the various work surfaces are extended and joined so as to form one continuous work surface provision being made to allow access to the volume of space within, and defined by, said columns.

In another important respect, the invention relates to a basic structure as defined above providing seating within the volume space defined by said columns whereby a person so situated may make use of the said work surfaces.

The prior art discloses various expedients for supporting work surfaces at convenient heights. While generically such expedients may all be defined as tables or work benches, none, to my knowledge, have been designed so as to define a volume of space within and surrounded by the basic unitary structure. Most often, in the prior art, the central area of a table or work bench is inefficiently utilized; the volume of space between the floor and the work surface in the central area being unavailable for use.

Therefore, it would be highly desirable to provide an improved structure which includes both work surfaces and an accessible volume of space centrally accessible by persons using said work surfaces. It would be particularly desirable to define such a structure in a manner whereby it may be easily convertible by minor modification at time of manufacture for multi-purpose use.

Accordingly, the principal object of the invention is to define a basic structure capable of supporting one or more work surfaces and having a centrally defined and usefully available spacial volume.

Another principal object of the invention is to provide a basic structure which by simple modification at time of manufacture may serve multiple purposes.

These and other objects and advantages of the invention will be apparent ot those skilled in the art from the following detailed description thereof, taken in conjunction with the drawings, in which.

Briefly, in accordance with the invention, I provide a stable base from which arise columns which are upwardly and outwardly directed so as to define a volume of usable space within their midst. Work surfaces are affixed to the top of said upward and outwardly inclined columns at convenient heights and in such a manner that the volume of space defined by said columns remains accessible to one utilizing said work surfaces. Simple modifications of the basic structure so defined are possible so as to permit the basic structure to be utilized for multiple and varying purposes.

According to one presently preferred embodiment of the invention, the basic structure is comprised of a stable base with four equi-spaced upward and outwardly rising columns, each column being surmounted by a work surface at a convenient height above said base and having a support surface located in the space defined by said columns and at a height displaced a desired distance below first aforementioned work surfaces. A simple modification of this one of the presently preferred embodiments comprises the addition of other support surfaces centrally located above the first such support surface mentioned above, said additional support surfaces being either fixed or capable of revolving in the manner of a lazy susan. An additional modification of this presently preferred embodiment includes the incorporation of means for tilting said work surfaces to a convenient working angle.

According to a second presently preferred embodiment of the invention, four columns rise upwardly and outwardly from a stable base and each is surmounted by a work surface accessible to a person or persons sitting within the space defined by said columns. A modification of this preferred embodiment includes the provision of a seating surface within the centrally defined volume of space. Other modifications of this preferred embodiment may include accessible storage space under said seating surface and the provision for tilting said work surfaces to a convenient working angle.

Figure 1:
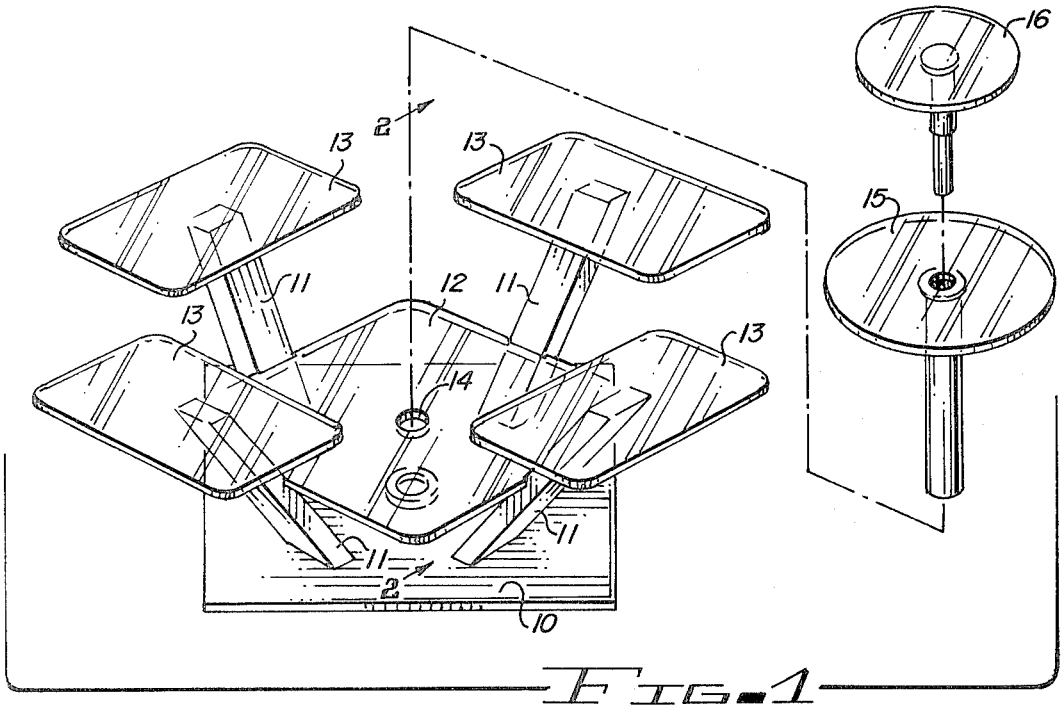
FIG. 1 shows the basic structure of a base with several upward and outwardly rising columns, to which columns work surfaces are affixed.
Figure 2:
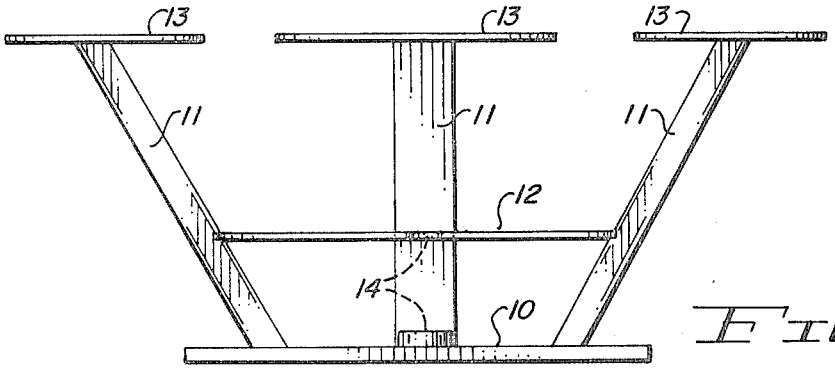
FIG. 2 is an elevation view of the basic structure in the embodiment indicated in FIG. 1.
Figure 3:
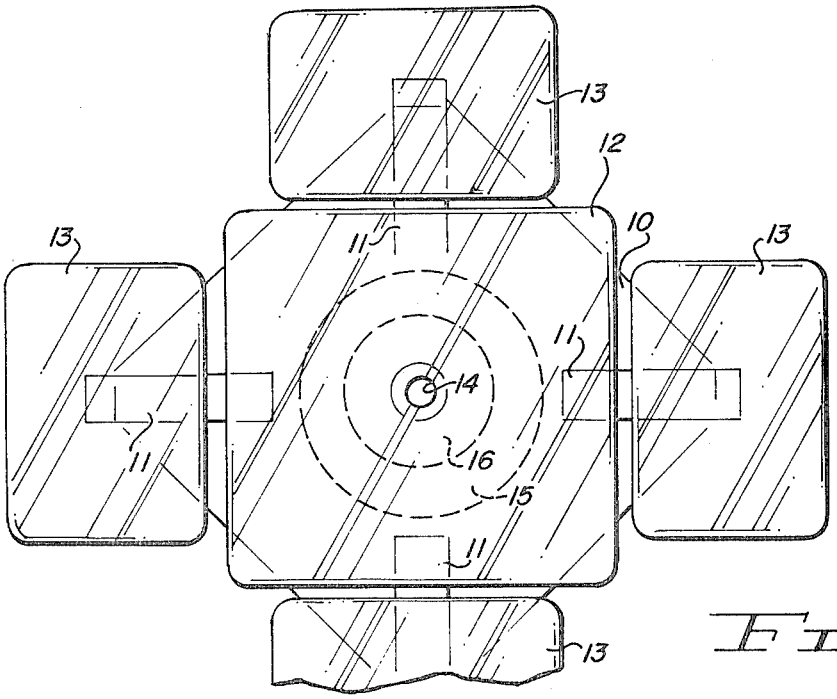
FIG. 3 is a plan view of the basic structure in the embodiment indicated in FIG. 1.

Turning now to the drawings in which several presently preferred embodiments to the invention are shown for purposes of illustration, FIG. 1 illustrates the basic structure of the multi-purpose display stand and tables. The basic structure consists of a base 10 from which rise four columns 11 extending upward and outwardly from base 10. At point some distance above base 10, columns 11 are joined by support structure 12. Columns 11 extend to a convenient height above a base 10 and are then surmounted by work surfaces 13. Provision may be made, as indicated by 14, to support a lazy susan device 15, which may itself provide the support for one or more other such lazy susan devices such as 16. FIGS. 2 and 3 provide elevation and plan views respectively of the basic structure. As illustrated in FIGS. 1, 2 and 3, the basic structure may be used for dining purposes, support 12 providing a surface upon which condiments may be placed, containers of edibles may be placed upon lazy susans 15 and 16, while place settings are set out on surfaces 13. In the basic arrangement shown, four persons may join together to dine. It is, of course, quite conceivable that the surfaces 13, illustrated as four separately defined surfaces, may be joined into one work surface with an opening in the center allowing access to the surface of support 12 and lazy susans 15 and 16. Such a singular work surface could be annular shaped or take any other desirable configuration.

FIGS. 1, 2 and 3 illustrate the basic structure in its preferred embodiment. If work surfaces 13 are placed at varying elevations, a pleasing display stand results. Provision may be made such that each work surface is pivotally mounted to the top of column 11 so as to provide a tiltable work surface. A potential use for an embodiment utilizing pivoted work surfaces would be in art classes wherein a student would be assigned to each position defined by a tiltable work surface and the subject matter for the art class's study would be placed on support surface 12 or on a surface such as might be provided by lazy susan 15. Each student would reproduce the subject matter from his or her own point of view. If a lazy susan such as 15 were provided to support the subject matter, each student could be given the opportunity to sketch or paint the subject matter from a variety of positions during the time the class is in session.

Figure 4:
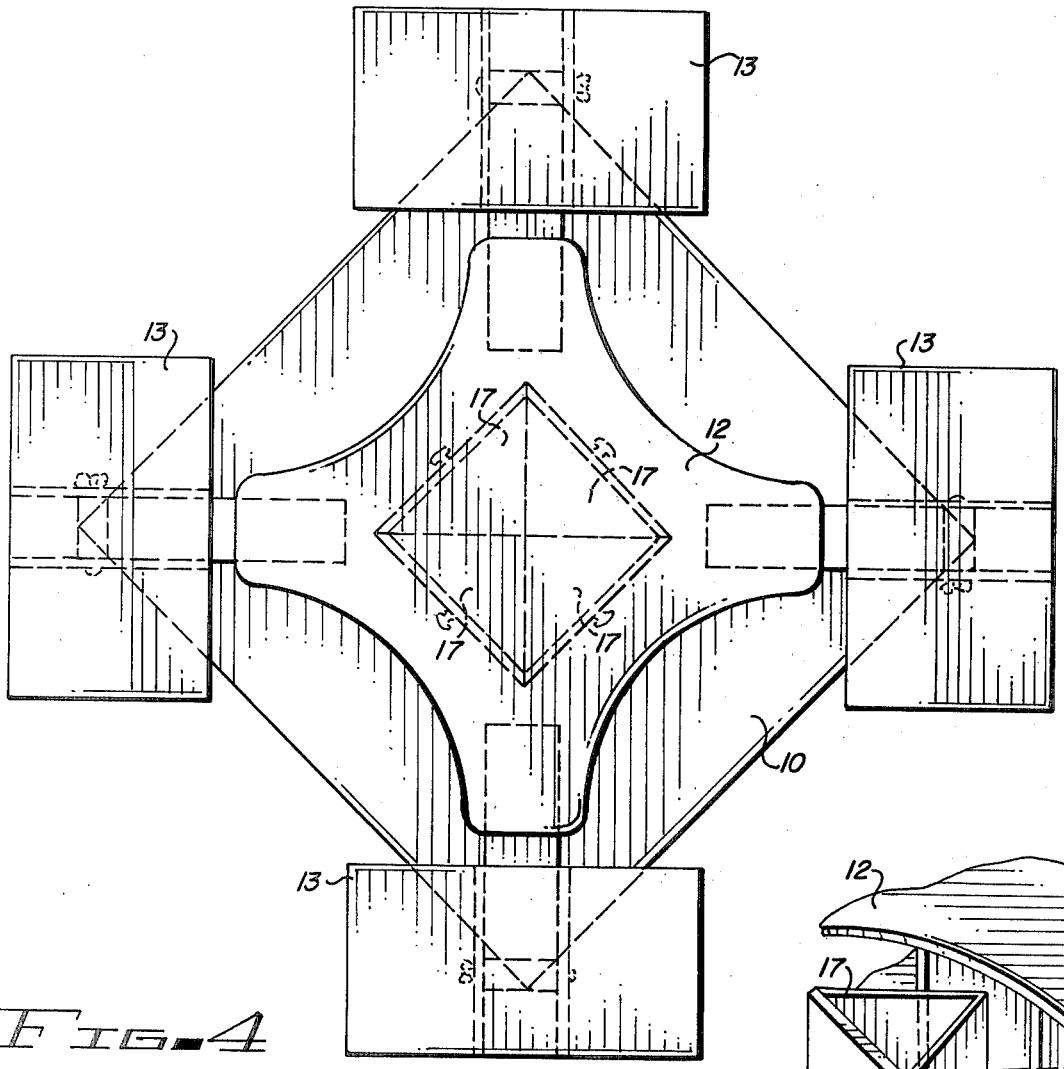
FIG. 4 shows a modified embodiment of the basic structure wherein seating is provided for four persons within the space defined by said several columns and the usable space beneath said seating arrangement is utilized for readily accessible storage means.

Support structure 12, like work surface 13, may assume any convenient shape to meet a desired need or to enhance its aesthetic aspects. Thus, in FIG. 4, the basic structure is shown in which support surface 12 is shaped so as to provide seating for four persons within the space defined by the inner edges of work surfaces 13. Such an arrangement would find use within the lower grade levels of elementary school classes. By providing work surfaces 13 as fixed or adjustable tilted work surfaces, four small children could share the basic structure while they performed independent classroom exercises. Storage containers for each child could readily be provided in the space defined by support 12 and base 10.

Figure 5:
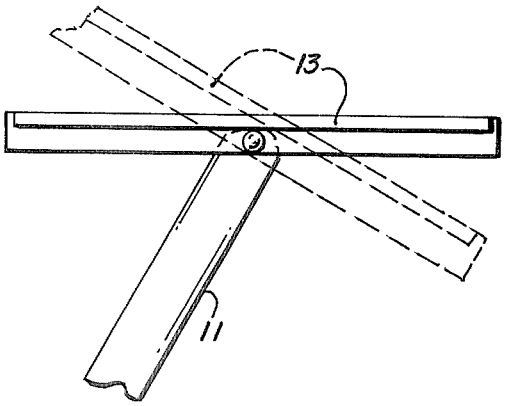
FIGS. 5 and 6 are two views of a simple modification which may be made to the work surface to provide for its being tilted to a convenient angle.
Figure 6:
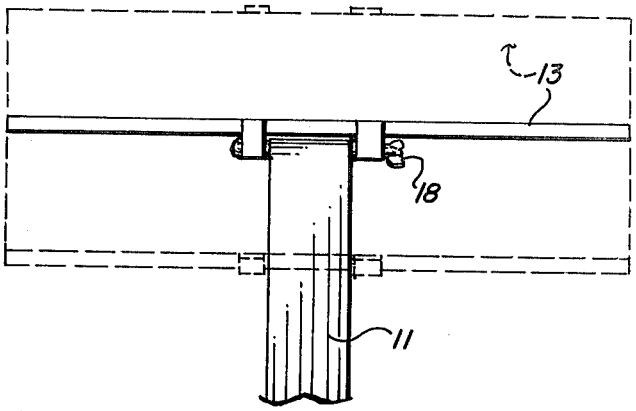

The ease with which a tiltable tabletop arrangement may be derived is illustrated in FIGS. 5 and 6 showing simple means of tilting work surface 13 by mounting it to the top of column 11 using a simple bolt and wing nut arrangement 18.

Figure 7:
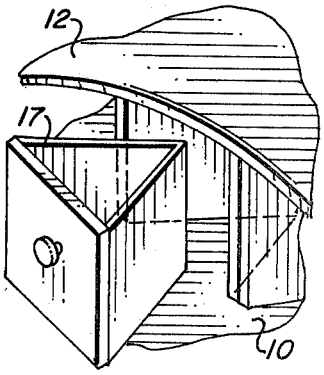
FIG. 7 is a partial view indicating the storage units available beneath the seat of the embodiment illustrated in FIG. 4.

FIG. 7 is a partial view of the volume of space defined by seating surface 12 and base 10 showing the type of storage container which might readily be placed therein.

Having described my invention in such clear and concise manner as to enable those skilled in the art to understand and practice it, and having described the presently preferred embodiments thereof, I claim:

1. A furniture construction comprising (a) a unitary base, (b) supports, attached at the lower ends to said base such that said supports maintain a constant fixed position with respect to said base, rising upwardly and outwardly from said base and defining a first central area of free space within said supports and a second peripheral area of free space outside and beneath said supports, (c) individual table top work surfaces attached to the upper ends of said supports and evenly spaced about the center of said table, each of said work surfaces being separate from the other of said work surfaces, said second peripheral area of free space permitting at least a portion of a chair to be positioned directly beneath each of said upper ends, (d) at least one support member positioned within said first central area of free space and interconnecting said supports, said support member being generally parallelably disposed with respect to said unitary base, and (e) a table member rotatably mounted in said support member and said base.

* * * * *